US006948957B1

(12) United States Patent
Costello et al.

(10) Patent No.: US 6,948,957 B1
(45) Date of Patent: Sep. 27, 2005

(54) SOCKET FOR RETAINING IN-LINE MODULES

(75) Inventors: Brian Patrick Costello, Scotts Valley, CA (US); Troy Everette Conner, York, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/840,470

(22) Filed: May 6, 2004

(51) Int. Cl.[7] ..... H01R 13/62
(52) U.S. Cl. ..... 439/157
(58) Field of Search ..... 439/157–160

(56) References Cited

U.S. PATENT DOCUMENTS 5,443,394 A * 8/1995 Billman et al. ..... 439/157
5,445,531 A 8/1995 Billman et al.
5,662,485 A 9/1997 Yip et al.
5,846,095 A * 12/1998 Bowen ..... 439/157
5,928,015 A * 7/1999 Tondreault ..... 439/157
6,200,149 B1 * 3/2001 Chi-Chung ..... 439/160
6,319,027 B1 11/2001 Pickles et al.
6,561,826 B2 * 5/2003 Puri et al. ..... 439/157

* cited by examiner

*Primary Examiner*—Truc Nguyen

(57) ABSTRACT

A socket for retaining a module includes a base extending along a longitudinal axis between opposite first and second ends. The base includes a slot extending along the longitudinal axis. The slot is configured to receive a contact mating edge of a module. The slot defines a module retention plane along which a module is inserted into the slot. An end bracket is joined to the base and extends along the module retention plane. At least one locking member is disposed on the end bracket. The locking member is configured to engage the module to prevent removal of the module once the module is fully inserted into the base.

20 Claims, 4 Drawing Sheets

SOCKET FOR RETAINING IN-LINE MODULES

BACKGROUND OF THE INVENTION

The invention relates generally to sockets for retaining modules in computer equipment and, more particularly, to a locking socket that inhibits unauthorized removal of an electronic module.

Computers may use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The modules are produced in a number of formats such as, for example, Single In-line Memory Modules (SIMM's), or the newer Dual In-line Memory Modules (DIMM's).

Typically, the modules are installed in one or more multi-pin sockets mounted on a system board or motherboard. As computers have become faster and more powerful, there has also been a demand for more and faster memory and processors. At least some sockets are designed to allow processors and memory to be supplemented, replaced, or upgraded in the field by an end user. However, while some systems can support memory modules of more than one type and size, the various types of memory modules available are not all interchangeable. Therefore, care should be taken that memory modules are used that are compatible with a given system when memory is being added or replaced in a system. If memory is installed that is incompatible with the system board, the system may fail, or at best become unreliable.

In certain applications, it is desirable that the end user not be able to remove processors or memory modules from the system so that problems that might arise from reconfiguration of the system do not occur. One approach to preventing removal of modules in the field involves soldering the processor or memory modules in the socket. Soldering the module into the socket is undesirable however, since it renders the module non-removable without de-soldering which can degrade the host board.

BRIEF DESCRIPTION OF THE INVENTION

In one embodiment, a socket for retaining a module is provided. The socket includes a base extending along a longitudinal axis between opposite first and second ends. The base includes a slot extending along the longitudinal axis. The slot is configured to receive a contact mating edge of a module. The slot defines a module retention plane along which a module is inserted into the slot. An end bracket is joined to the base and extends along the module retention plane. At least one locking member is disposed on the end bracket. The locking member is configured to engage the module to prevent removal of the module once the module is fully inserted into the base.

Optionally, the end bracket includes a channel that joins the slot. The locking member is formed within the channel in the end bracket. The locking member is configured to engage a notch formed in an edge of the module. The locking member includes a locking arm having a bevel projection and a locking surface. A side edge of the module slides past the bevel projection and the locking surface engages a notch in the side edge of the module. The end bracket includes a pair of side walls and an end wall defining an open-sided channel. The locking member is positioned between the side walls within the open-sided channel.

In another embodiment, a socket for retaining a module includes a base extending along a longitudinal axis between opposed first and second ends. The base includes a slot for receiving a contact mating edge of the module. An end bracket is provided at one of the opposed first and second ends of the base. The end bracket is bifurcated into a lower end bracket portion and an upper end bracket portion joined to one another. The upper and lower end bracket portions are permanently joined to one another. A locking member is disposed on the end bracket. The locking member is configured to engage the module to prevent removal of the module from the base.

DETAILED DESCRIPTION OF THE INVENTION

Figure 1:
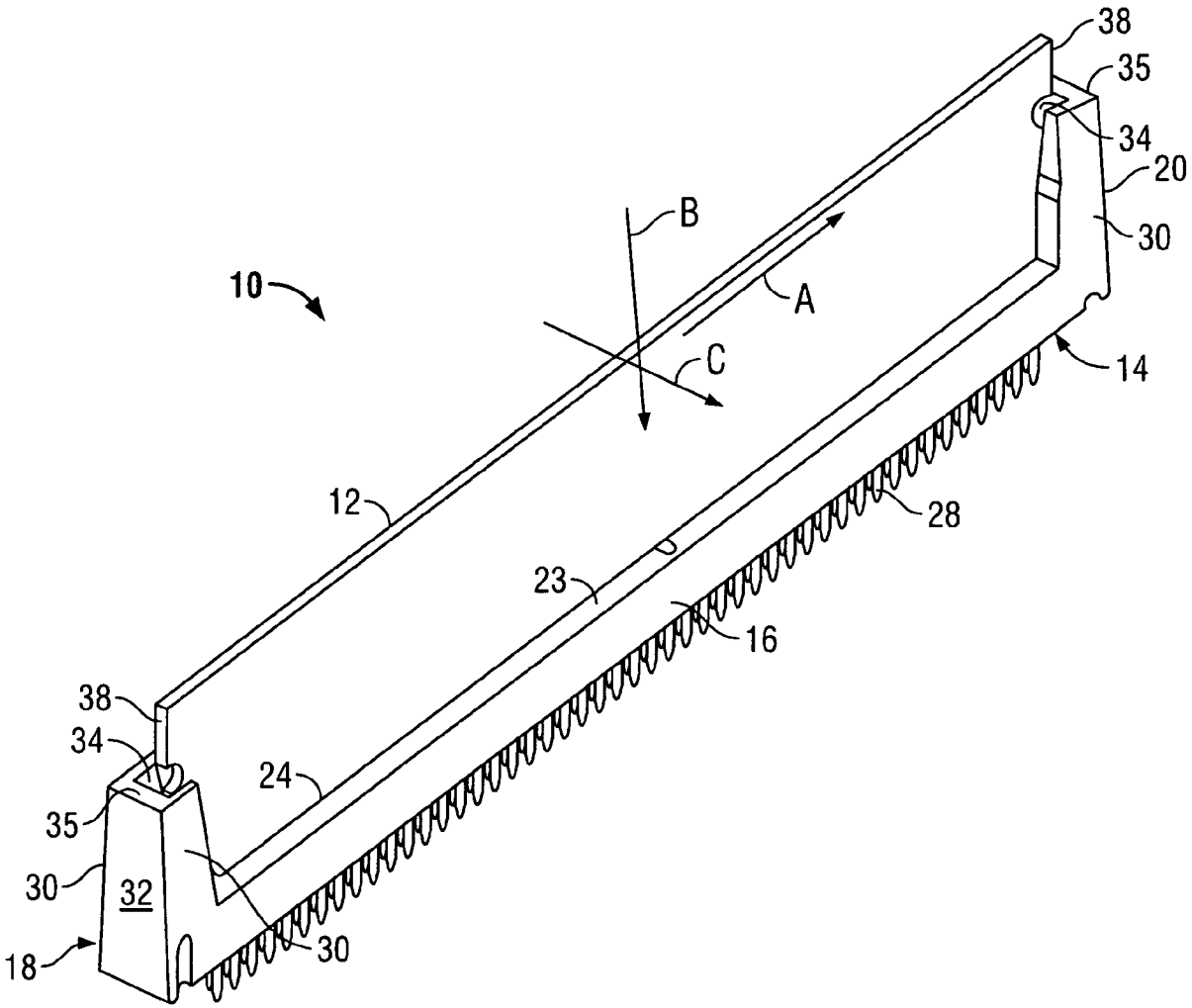
FIG. 1 is a perspective view of a locking socket for a memory module in accordance with an exemplary embodiment of the present invention.

FIG. 1 illustrates an exemplary socket 10 used to mount a memory module 12 on a circuit board (not shown). The memory module 12, in one embodiment, may be a Dual In-Line Memory Module (DIMM); however, no limitation is intended thereby. Alternative embodiments of the socket 10 may be used with other types of modules such as Single In-Line Memory Modules (SIMM) and other edge mounted memory modules. Memory sockets such as socket 10 allow circuit boards, such as motherboards used in computer equipment, to be made in somewhat standard configurations that can later be customized when memory is added. Memory modules such as the memory module 12 can also be manufactured with varying memory capacities that can be installed in the same memory socket such as the socket 10.

The socket 10 includes a housing 14 that has a base 16 extending along a longitudinal axis A between opposed end brackets 18 and 20. The base 16 includes an upper edge 23 having a slot 24 therein that is configured to receive the contact mating edge (not shown in FIG. 1) of the module 12. The slot 24 extends along the longitudinal axis A of the base 16. The base 16 includes an array of contacts 28 which are positioned laterally on both sides of the slot 24. The contacts 28 connect with electrical traces on the circuit board when the socket 10 is mounted on the circuit board. The contacts 28 interconnect pads (not shown) on the module 12 with the electrical traces on the circuit board when the module 12 is installed in the socket 10. The housing 14 is fabricated from a dielectric material and is typically surface mounted on the circuit board via the contacts 28 using techniques well known in the art.

In one embodiment, each end bracket 18 and 20 includes a pair of side walls 30 and an end wall 32. End brackets 18 and 20 are provided with channels 34 that are aligned with and face one another. The channels 34 are dimensioned and configured to receive respective side edges 38 of the module 12.

Figure 2:
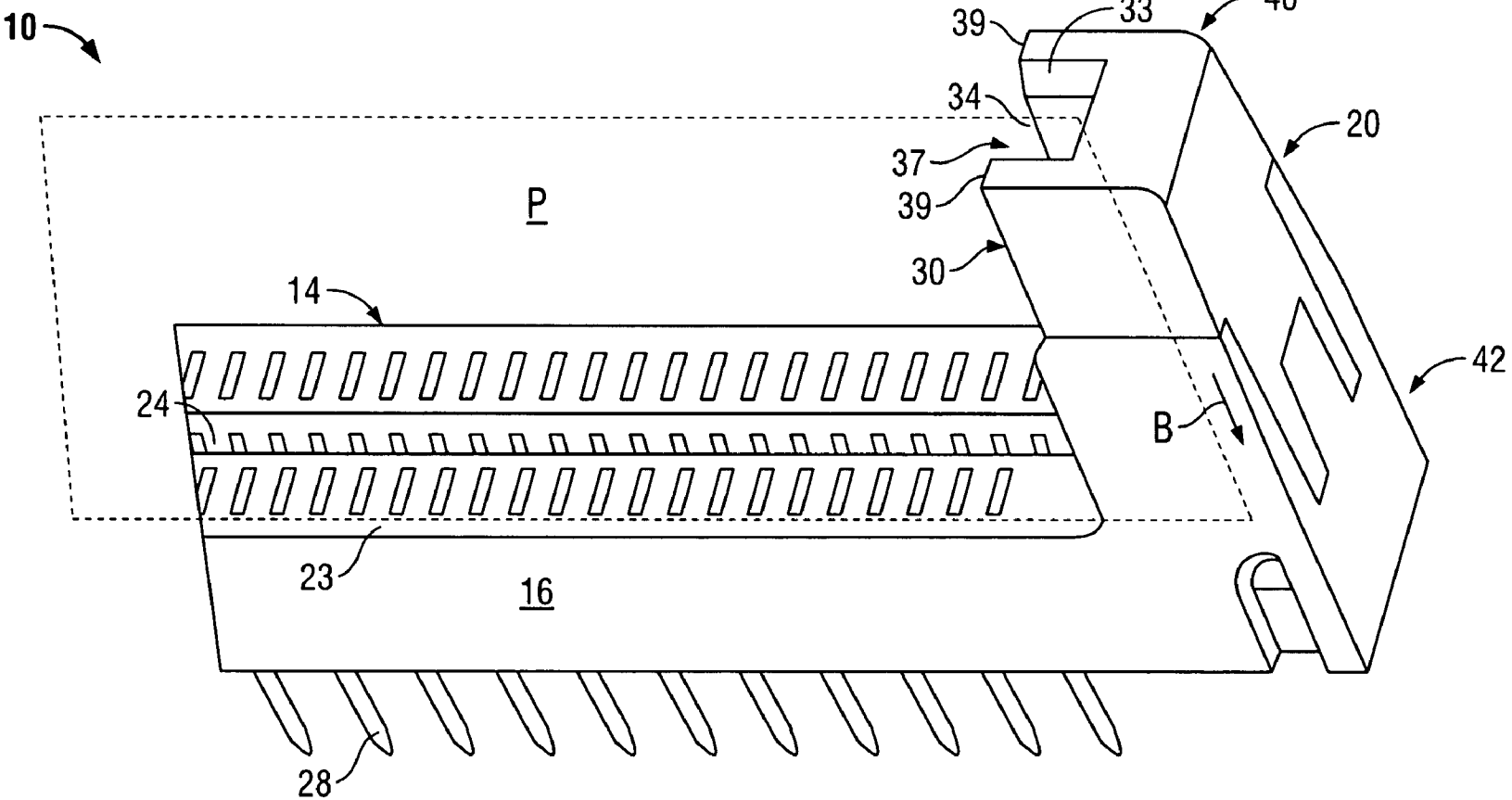
FIG. 2 is a partial perspective view showing an end of the socket of FIG. 1.

FIG. 2 is a partial perspective view showing a portion of the base 16 and the end bracket 20 of the socket 10. The end bracket 20 is bifurcated into an upper end bracket portion 40 and a lower end bracket portion 42. The channel 34 extends from the top surface 35 downward through the upper end bracket portion 40 and into the lower end bracket portion 42. The channels 34 have an open end 33 at the top surface 35 and an open side 37 proximate edges 39 of the side walls 30. The open sides 37 of the channels 34 face one another and are aligned parallel to, and along, a module retention plane P (denoted in dashed lines in FIG. 2). The channels 34 and slot 24 are aligned in and define sides and an end of the module retention plane that extends orthogonally upward from the base 16. The module 12 (shown in FIG. 1) is inserted in the direction of arrow B along the module retention plane P. The end brackets 18 and 20 provide lateral support to the module 12 along the direction denoted by arrow C (shown in FIG. 1).

Figure 3:
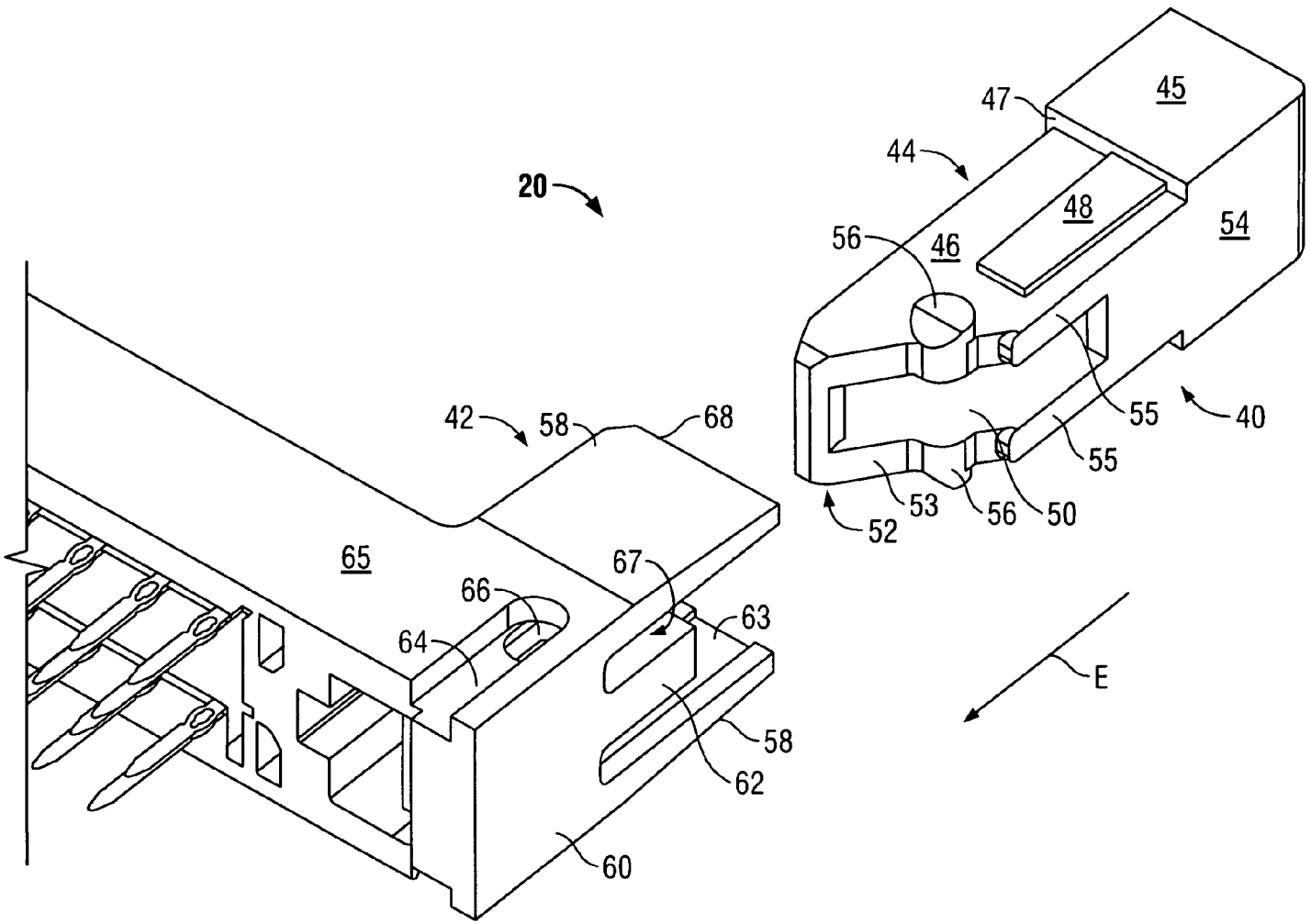
FIG. 3 is an exploded view of an end bracket of the socket shown in FIG. 1.

FIG. 3 illustrates an exploded view of the end bracket 20. The upper bracket portion 40 includes a body 44 with upper and lower stepped sides 45 and 46 respectively. Stepped sides 45 and 46 are joined at a shoulder 47. The lower stepped side 46 includes a raised tab 48. The body 44 includes a slot 50 that extends upwardly from a lower end 52 of the stepped side 46. The lower end 52 of the lower stepped sides 46 includes angled edges 53 that extend to an end wall 54. The end wall 54 has a pair of side sections 55 that define a portion of the slot 50. A locking latch 56 is formed on the angled edge 53 of each lower stepped side 46.

The lower bracket portion 42 includes a pair of side panels 58 that extend upwardly from a base section 60. A tongue portion 62 also extends upwardly from the base section 60 between the side panels 58. A recessed channel 63 is formed on an inner surface of the side panels 58. A latch slot 64 is formed on an outer surface 65 of the base section 60. The latch slot 64 has a locking hole 66 that extends into a cavity 67 between the tongue portion 62 and the side panels 58.

The upper and lower bracket portions 40 and 42 respectively, are joined by positioning the upper bracket portion 40 above the lower bracket portion 42 and inserting the upper bracket portion 40 into the lower bracket portion 42 in the direction of arrow E until the upper ends 68 of the side panels 58 abut the shoulder 47 on upper bracket portion 40. The tongue portion 62 is received in the slot 50 and the tabs 48 are received in the recessed channels 63 as the upper and lower bracket portions 40 and 42 are joined. The locking latches 56 slide along the recessed channels 63 and snap into the locking hole 66 to lock the upper and lower bracket portions 40 and 42 together. In the assembled end brackets 18 and 20, the interleaving of the side panels 58, and tongue portion 62 with the lower stepped sides 46 yields a structure the enhances the strength and reliability of the end brackets 18 and 20.

In an alternative embodiment, the end brackets 18 and 20 may be formed each as a single unitary piece joined to the base 16. In another embodiment, the end brackets 18 and 20 may be integral with the base 16.

Figure 4:
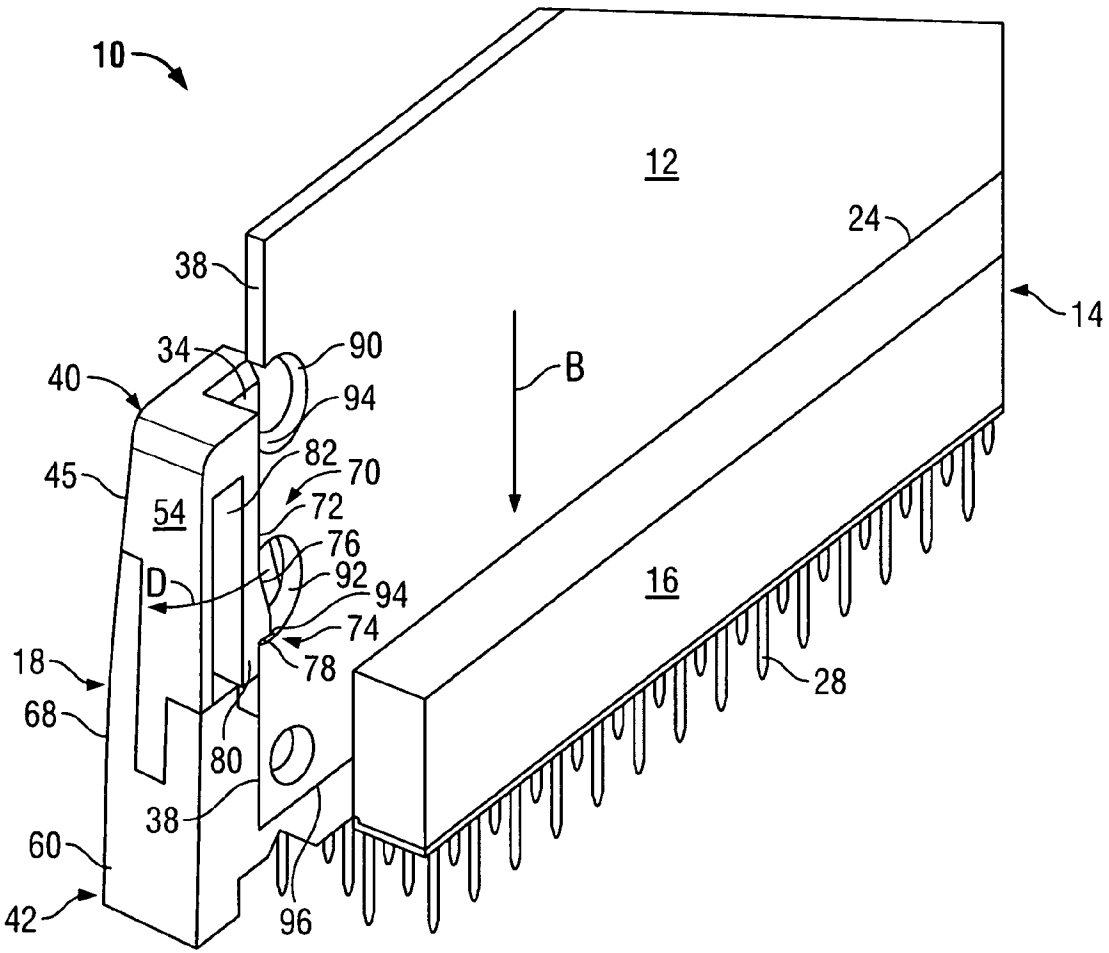
FIG. 4 is a partial perspective cut away view of the socket of FIG. 1 showing a locking member in accordance with an exemplary embodiment of the present invention.

FIG. 4 is a partial perspective cut away view of the end bracket 18 of the socket 10. The end bracket 18 includes a locking member 70 located between the stepped sides 45 and 46 (stepped side 46 is not shown in FIG. 4). The locking member 70 prevents removal of the module 12 once fully inserted into the channel 34 and slot 24. The locking member 70 includes a locking arm 72 that has a lower end 74 that includes a bevel projection 76, a locking surface 78, and a stop surface 80. The bevel projection 76 extends into the channel 34 and faces the opposed end bracket 20. A relief channel 82 is provided in the end wall 54 behind the locking arm 72. The locking arm 72 is normally biased in a stress free state such that the bevel projection 76 extends into the channel 34. The locking arm 72 is deflectable in the direction of arrow D out of the channel 34 and into the relief channel 82. Optionally, the end bracket 20 may also include a similar locking member 70.

As shown in FIG. 4, notches 90 and 92 are provided in the module 12 and are standard in the construction of modules such as DIMMS. The notches 90 and 92 each includes an upward facing surface 94 adjacent the side edge 38 of the module 12. A contact mating edge 96 of the module 12 is also shown seated in the slot 24.

During assembly, the housing 14 is attached to the circuit board (not shown) via the contacts 28. The upper end bracket portions 40 at opposite end brackets 18 and 20 may be joined to the lower end bracket portions 42 of the housing 14, as described above, either before or after the housing 14 is mounted on the circuit board. The module 12 is inserted into the channel 34 of the socket 10, in the direction of arrow B, beginning with the contact mating edge 96 and then the side edges 38. As the contact mating edge 96 and the lower portion of the side edge 38 encounter the bevel projection 76 on the locking arm lower end 74, the locking arm 72 is deflected in the direction of arrow D into the relief channel 82. As the module 12 is seated in the slot 24 in the base 16, the lower edge of the side edge 38 moves past the bevel projection 76 allowing the locking arm 72 to move back toward its original position. The stop surface 80 rests against the side edge 38 and the locking surface 78 engages the upward facing surface 94 of the notch 92 adjacent the side edge 38 of the module 12. At this point, the module 12 is fully installed. Interference between the locking surface 78 and the notch upward facing surface 94 prevents the removal of the module 12 without damage to or the destruction of the socket 10, or the module 12, or both.

The embodiments thus described provide a cost effective locking module socket that inhibits removal of a module once the module is installed in the socket. The locking module socket facilitates the avoidance in the field of problems associated with the replacement of the factory installed modules with unqualified or incompatible modules. The locking module socket also prevents changes in the configuration of the system. The locking module socket reduces service and warranty expense.

Optionally, the socket 10 may be used with other card type modules besides memory modules. For example, the socket 10 may receive a daughter card or mother board containing a variety of circuit components, each of which is encompassed within the term module as used throughout.

While the invention has been described in terms of various specific embodiments, those skilled in the art will recognize that the invention can be practiced with modification within the spirit and scope of the claims.

What is claimed is:

1. A socket for retaining a module, comprising:

a base extending along a longitudinal axis between opposite first and second ends, said base including a slot extending along said longitudinal axis, said slot being configured to receive a contact mating edge of a module, said slot defining a module retention plane along which a module is inserted into said slot;

an end bracket fixedly coupled to said base, said end bracket extending along said module retention plane, and said end bracket defining a relief channel therein; and a locking member disposed on said end bracket proximate said relief channel, wherein the module engages said locking member to deflect said locking member into said relief channel when the module is partially inserted in said base, and wherein said locking member engages the module being to prevent removal of the module once the module is fully inserted into said base.

2. The socket of claim 1, wherein said base retains a plurality of contacts arranged along said slot and configured to mate with a corresponding plurality of pads on the module.

3. The socket of claim 1, wherein said end bracket includes a channel that joins said slot, said locking member being formed within said channel in said end bracket.

4. The socket of claim 1, wherein said locking member is configured to engage a notch formed in an edge of the module.

5. The socket of claim 1, further comprising first and second end brackets formed integrally with said base at said opposite first and second ends of said base, said first and second end brackets having channels therein that face one another.

6. The socket of claim 1, wherein said end bracket includes a channel configured to receive a non-contact edge of the module.

7. The socket of claim 1, wherein said locking member includes a locking arm having a bevel projection and a locking surface, a side edge of the module sliding past said bevel projection, said locking surface engaging a notch in the side edge of the module.

8. The socket of claim 1 further comprising a pair of said end brackets each including one of said locking members.

9. The socket of claim 1, wherein said end bracket includes a pair of side walls and an end wall defining an open-sided channel, said locking member being positioned between said side walls within said open-sided channel.

10. A socket for retaining a module, comprising:

a base extending along a longitudinal axis between opposed first and second ends, said base including a slot for receiving a contact mating edge of the module;

an end bracket provided at one of said opposed first and second ends of said base, said end bracket being bifurcated into a lower end bracket portion and an upper end bracket portion, said upper and lower end bracket portions being permanently joined to one another and coupled to said base in a fixed relationship; and a deflectable locking member disposed on said end bracket, said locking member being configured to engage the module to prevent removal of the module from said base when the module is fully inserted in said base.

11. The socket of claim 10, wherein said base retains a plurality of contacts arranged along said slot and configured to mate with a corresponding plurality of pads on the module.

12. The socket of claim 10, wherein said end bracket includes a channel that joins said slot, said locking member being formed within said channel in said end bracket.

13. The socket of claim 10, wherein said locking member is configured to engage a notch formed in an edge of the module.

14. The socket of claim 10, further comprising a pair of said end brackets located at said opposed first and second ends of said base, each said end bracket being bifurcated into a lower end bracket portion and an upper end bracket portion snapably joined to one another.

15. The socket of claim 10, further comprising first and second end brackets each including an open sided channel arranged with said slot to form a module retention plane, said open sided channels receiving a non-contact edge of the module.

16. The socket of claim 10, wherein said locking member includes a locking arm having a bevel projection and a locking surface, a side edge of the module sliding past said bevel projection, said locking surface engaging a notch in the side edge of the module.

17. The socket of claim 10, further comprising a pair of said end brackets, each of which includes one of said locking members.

18. The socket of claim 10, wherein said upper and lower end bracket portions each includes projections interleaved to join one another at an interface between said upper and lower end brackets.

19. The socket of claim 10, wherein said end bracket includes an open-ended, open-sided channel that communicates and aligns with said slot in said base.

20. The socket of claim 10, wherein said end bracket extends orthogonally from said base parallel to a module retention plane, said end bracket being configured to receive a module along said module retention plane.

* * * * *